US006645923B2

(12) United States Patent
Dunn et al.

(10) Patent No.: US 6,645,923 B2
(45) Date of Patent: Nov. 11, 2003

(54) LUBRICATING OIL COMPOSITION

(75) Inventors: Adrian Dunn, Oxfordshire (GB); Laurent Chambard, Oxfordshire (GB); Terence Garner, Oxfordshire (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/970,631

(22) Filed: Oct. 4, 2001

(65) Prior Publication Data

US 2002/0098991 A1 Jul. 25, 2002

(30) Foreign Application Priority Data

Oct. 5, 2000 (EP) ..... 00121752

(51) Int. Cl.[7] ..... C10M 159/20
(52) U.S. Cl. ..... 508/460
(58) Field of Search ..... 508/460

(56) References Cited

U.S. PATENT DOCUMENTS 5,726,133 A 3/1998 Blahey et al. ..... 508/390
5,792,735 A * 8/1998 Cook et al. ..... 508/452
5,906,969 A 5/1999 Fyfe ..... 508/364
6,008,165 A * 12/1999 Shanklin et al. ..... 508/185
6,034,039 A * 3/2000 Gomes et al. ..... 508/331
6,103,672 A * 8/2000 Dunn et al. ..... 508/185
6,140,282 A * 10/2000 Cartwright et al. ..... 508/398
6,159,911 A * 12/2000 Katafuchi ..... 508/391
6,162,769 A * 12/2000 Polhaar et al. ..... 508/339
6,191,081 B1 * 2/2001 Cartwright et al. ..... 508/460

FOREIGN PATENT DOCUMENTS

WO WO94/28095 A1 12/1994 ..... C10M/135/18
WO WO97/46645 A1 12/1997 ..... C10M/159/22
WO WO99/55808 A1 11/1999 ..... C10M/159/20

* cited by examiner

*Primary Examiner*—Jacqueline V. Howard

(57) ABSTRACT

A gas-fuelled engine lubricating oil composition having a TBN in the range of 2 to 20 and comprising:

(A) oil of lubricating viscosity;
(B) a salicylate detergent having a TBN of 95 or less;
(C) a detergent having a TBN of greater than 250;
(D) an ashless dispersant; and
(E) an anti-wear additive.

10 Claims, No Drawings

LUBRICATING OIL COMPOSITION

This invention relates to gas-fuelled engine lubrication.

Gas-fuelled engines, sometimes referred to as gas-fired engines or merely gas engines, are known and may be used in the oil and gas industry, for example, to drive pumping stations of natural gas pipelines, blowers and generators in purification plants and on gas tankers, to compress natural gas at well heads and along pipe lines and to produce electric power in fit-for-purpose plants. Their design may be two- or four-stroke, spark-ignited or compression-ignited, though four-stroke compression-ignited designs constitute a large percentage. Natural gas constitutes a typical fuel.

Problems in their lubrication are firstly, that the lubricant is subjected to sustained high temperatures leading to its oxidation, and secondly, that the engines emit relatively high quantities of oxides of nitrogen, leading to nitration of the lubricant. These problems reduce the working life of the lubricant.

U.S. Pat. No. 5,726,133 describes a way of meeting the above problems by using, in a natural gas engine oil, an additive mixture comprising a mixture of detergents comprising at least one first alkali or alkaline earth metal salt or mixture thereof of TBN of 250 and less, and at least one second alkali or alkaline earth metal salt or mixture thereof which is more neutral than the first salt.

EP-A-0 860 495 describes a lubricating oil composition stated to be excellent for NOx oxidation resistance and thermal oxidation resistance and suitable as a long-life engine oil for gas engine heat pumps. The composition includes a metal salicylate having a TBN of from 100 to 195, and optionally includes a metal phenate having a TBN of from 100 to 300.

There is, however, a desire to further improve the lubricant performance in the above respects, for example to enable the interval between lubricant changes to be extended.

The present invention meets this desire, as evidenced by and in the examples hereof, by using, as a first detergent, a salicylate having a TBN of 95 or less and a second detergent having a TBN of greater than 250.

Accordingly, a first aspect of the present invention is a gas-fuelled engine lubricating oil composition having a TBN in the range of 2 to 20 comprising:

(A) an oil of lubricating viscosity, in a major amount; and added thereto, in respective minor amounts:

(B) one or more metal hydrocarbyl-substituted salicylate detergents having a TBN of 95 or less, preferably 85 or less, more preferably 75 or less;

(C) one or more metal detergents, preferably salicylate, phenate or complex detergents, having a TBN of greater than 250, preferably greater than 265, more preferably greater than 275;

(D) preferably one or more dispersants, such as an ashless dispersant; and (E) preferably one or more anti-wear additives.

A second aspect of the present invention is a method of lubricating a gas-fuelled internal combustion engine, the method comprising operating the engine and lubricating it with the composition defined above according to the first aspect of the invention.

A third aspect of the present invention is a method for enhancing the resistance of a gas-fuelled lubricating oil composition to oxidation and nitration, the method comprising the step of adding additives (B) to (E) as defined in the first aspect of the invention to the gas-fuelled lubricating oil composition.

"Major amount" means in excess of 50 mass % of the composition.

"Minor amount" means less than 50 mass % of the composition, both in respect of the stated additive and in respect of the total mass % of all the additives present in composition, reckoned as active ingredient of the additive or additives.

"Comprises or comprising" or cognate words is taken to specify the presence of stated features, steps, integers or components, but does not preclude the presence or addition of one or more other features, steps, integer components or groups thereof.

"TBN" (Total Base Number) is as measured by ASTM D2896.

Unless otherwise started, all proportions are expressed as mass % active ingredient, i.e. as if solvent or diluent or other inert material were absent.

The features of the invention will now be discussed in more detail below.

Lubricating Oil Composition

Preferably, the TBN of the lubricant composition is in the range of from 2 to 20, such as from 2.5 to 20, preferably from 6.5 to 20, more preferably from 6.5 to 15.

(A) Oil of Lubricating Viscosity

The oil of lubricating viscosity (sometimes referred to as lubricating oil) may be any oil suitable for the lubrication of a gas-fuelled engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tridecyl adipate, or polymeric hydrocarbon lubricating oils, for example liquid polyisobutene and polyalpha olefins. Commonly, a mineral oil is employed. The lubricating oil may generally comprise greater than 60, typically greater than 70, mass % of the composition, and typically have a kinematic viscosity at 100° C. of from 2 to 40, for example for 3 to 15, $mm^2s^{-1}$ and a viscosity index of from 80 to 100, for example from 90 to 95.

Another class of lubricating oils is hydrocracked oils, where the refining process further breaks down the middle and heavy distillate fractions in the presence of hydrogen at high temperatures and moderate pressures. Hydrocracked oils typically have a kinematic viscosity at 100° C. of from 2 to 40, for example from 3 to 15, $mm^2s^{-1}$ and a viscosity index typically in the range of from 100 to 110, for example from 105 to 108.

The oil may include 'brightstock' which refers to base oils which are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, mass %, based on the mass of the composition.

(B) Salicylate Detergent

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants, which, in respect of (B), is salicylic acid.

The detergent comprises a polar head with a long hydrophobic tail, the polar head comprises a metal salt of the salicylic acid. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The metal may be an alkali or alkaline earth metal, e.g., sodium, potassium, lithium, calcium, and magnesium. Calcium is preferred.

Surfactants for the surfactant system of the overbased metal detergents contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility.

The salicylates may be non-sulfurized or sulfurized, and may be chemically modified and/or contain additional substitutents. Processes for sulfurizing a hydrocarbyl-substituted salicylic acid are well known to those skilled in the art. Salicylic acids are typically prepared by the carboxylation, by the Kolbe-Schmitt process, of phenoxides, and in that case, will generally be obtained, normally in a diluent, in admixture with uncarboxylated phenol.

Preferred substituents in oil-soluble salicylic acids from which the salicylates may be derived are alkyl substituents. In alkyl-substituted salicylic acids, the alkyl groups advantageously contain 5 to 100, preferably 9 to 30, especially 14 to 20, carbon atoms. Where there are more than one alkyl groups, the average number of carbon atoms in all of the alkyl groups is preferably at least 9 to ensure adequate oil-solubility.

The gas-fuelled engine lubricating oil composition preferably includes only one metal hydrocarbyl-substituted salicylate detergent having a TBN of 95 or less, component (B).

The salicylate may be used in a proportion in the range of 0.5 to 30, preferably 2 to 15 or to 20, mass % based on the mass of the lubricating oil composition.

(C) Metal Detergents Having a TBN Greater than 250

The surfactants that may be used include salicylates, sulfonates, phenates, sulfurized phenates, thiophosphates, naphthenates, oil-soluble carboxylates or complex detergents. The surfactants are preferably salicylates, phenates or complex detergents. The metal may be an alkali metal or an alkaline earth metal such as sodium, potassium, lithium, calcium and magnesium. Calcium is preferred.

Complex detergents comprise an overbased mixture of at least two metal surfactants, such as a calcium alkyl phenate and a calcium alkyl salicylate. Such a complex detergent is a hybrid material in which the surfactant groups, e.g. phenate and salicylate, are incorporated during the overbasing process. Examples of complex detergents are described in the art.

Another example of a detergent that may be used comprises a sulfurized and then overbased mixture of a calcium alkyl phenate and a calcium alkyl salicylate such as described in EP-A-750,659, for example as:

a detergent-dispersant additive for lubricating oil of the sulfurised and superalkalinised, alkaline earth alkylsalicylate-alkylphenate type, characterised in that:

(a) the alkyl substituents of the said alkylsalicylate-alkylphenate are in a proportion of at least 35 wt. % and at most 85 wt. % of linear alkyl in which the number of carbon atoms is between 12 and 40, preferably between 18 and 30 carbon atoms, with a maximum of 65 wt. % of branched alkyl in which the number of carbon atoms is between 9 and 24 and preferably 12 carbon atoms;

(b) the proportion of alkylsalicylate in the alkylsalicylate-alkylphenate mixture is at least 22 mole % and preferably at least 25 mole %, and (c) the molar proportion of alkaline in the alkylsalicylate-alkylphenate as a whole is between 1.0 and 3.5.

Preferably, the metal detergents (C) have a TBN in the range of 250 to 500, more preferably 260 to 400.

(D) Dispersants

A dispersant is an additive for a lubricating composition whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricating oil, thus preventing sludge flocculation and precipitation or deposition on metal parts of the engine.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, e.g. polyisobutene succinic anhydride; and polyamine condensation products that may be borated or unborated.

(E) Antiwear Additive

The antiwear additives may be metallic or non-metallic, preferably the former.

Dihydrocarbly dithiophosphate metal salts are examples of the anti-wear additives used in the present invention. The metal in the dihydrocarbyl dithiophosphate metal may be an alkali or alkaline earth metal, or aluminum, lead, tin, molybdenum, manganese, nickel or copper. Zinc salts are preferred, preferably in the range of 0.1 to 1.5, preferably 0.5 to 1.3, mass %, based upon the total mass of the lubricating oil composition. They may be prepared in accordance with known techniques by firstly forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary and hydrocarbyl groups that are entirely primary. To make the zinc salt, any basic or neutral zinc compound may be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil-soluble salts of dihydrocarbyl dithiophosphoric acids and may be represented by the following formula:

$[(RO)(R^1O)P(S)S]_2Zn$ where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, l-propyl, n-butyl, l-butyl, sec-butyl, amyl, n-hexyl, l-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophoshoric acid will generally be 5 or greater. The zinc dihydrocarbyl dithiophosphate can therefore comprise zinc dialkyl dithiophosphates.

The composition of the present invention may, optionally, have further added there-to in a minor amount (F) one or more antioxidants as discussed in further detail below.

(F) Anti-Oxidants

As stated these may be amines or phenolic. As examples of amines there may be mentioned secondary aromatic amines such as diarylamines, for example diphenylamines wherein each phenyl group is alkyl-substituted with an alkyl group having 4 to 9 carbon atoms. As examples of anti-oxidants there may be mentioned hindered phenols, including mono-phenols and bis-phenols.

Preferably, the anti-oxidant, if present, is provided in the composition in an amount of up to 3 mass %.

Other additives such as pour point depressants, anti-foamants, and/or demulsifiers may be provided, if necessary.

It may be desirable, although not essential, to prepare one or more additive packages or concentrates comprising the additives, whereby additives (B) to (E), and (F) if provided, can be added simultaneously to the base oil to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. Thus, additives (B) to (E), and (F) if provided, in accordance with the present invention, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

The term 'active ingredient' (a.i.) as used herein refers to the additive material that is not diluent.

The terms 'oil-soluble' or 'oil-dispersable' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

EXAMPLES

The present invention is illustrated by, but in no way limited to, the following examples.

Examples 1 & 2

Gas-fuelled engine lubricating oil compositions of the invention were prepared by blending methods known in the art. Their compositions were as follows:

| | COMPONENTS | Example 1 | Example 2 |
|---|---|---|---|
| (B) | Ca salicylate, TBN 65 | 3.46 | 3.85 |
| (C) | Ca salicylate, TBN 281 | 0.35 | 0.39 |
| (D) | Borated succinimide dispersant | 3.41 | 3.80 |
| | Unborated succinimide dispersant | 2.58 | 2.88 |
| (E) | ZDDP anti-wear additive | 0.26 | 0.29 |
| (F) | Diphenylamine anti-oxidant | 0.35 | 0.39 |
| (A) | Base Oil | Balance | Balance |
| | TBN | 7.1 | 8 |
| | Ash (sulfated) (%) | 0.45 | 0.50 |
| (Antifoams were also present) | | | |

The above figures, where appropriate, represent mass % of an additive components that, with the exception of (F), includes diluent or solvent. The figure for (F) represents active ingredient.

Comparison Examples

As comparison gas-fuelled engine lubricating oil compositions (Examples A and B), there were used commercially available lubricating oils, the detergency of each of which was phenate-based and was salicylate-free. Example A had a TBN of 5.2 and 0.45% sulfated ash and Example B had a TBN of 8.8 and 0.80% sulfated ash.

Tests

Samples of Examples 1, 2, A and B were each tested according to the GFC T021-A-90 procedure, an industry standard, at 170° C. for a period of 216 hours, with an intermediate sampling after 144 hours.

The samples were analysed for:

kinematic viscosity at 100° C. (ASTM D445)

TAN (ASTM D664)

TBN (ASTM D2896)

Infra-Red Oxidation and Nitration (spectroscopic method known in the art)

The identity of the method is indicated in parentheses

Results

The results of the tests are summarised in the table below.

| SAMPLE | | TEST TIME (hours) | | |
|---|---|---|---|---|
| (EXAMPLE REF) | TEST | 0 | 144 | 216 |
| 1 | VISCOSITY | 14.08 | 15.43 | 17.43 |
| 2 | ($mm^2s^{-1}$) | 14.38 | 15.37 | 17.59 |
| A | | 13.66 | 23.27 | — |
| B | | 14.05 | 18.25 | 26.89 |
| 1 | TAN | 0.59 | 2.02 | 4.14 |
| 2 | (mg $KOHg^{-1}$) | 0.65 | 0.71 | 3.65 |
| A | | 0.44 | 5.64 | 8.22 |
| B | | 0.38 | 4.45 | 7.17 |
| 1 | TBN | 7.12 | 2.47 | 1.44 |
| 2 | (mg $KOHg^{-1}$) | 7.96 | 3.08 | 1.75 |
| A | | 5.22 | 0.5 | 0.5 |
| B | | 8.81 | 0.5 | 0.5 |

-continued

| SAMPLE (EXAMPLE REF) | TEST | TEST TIME (hours) 0 | 144 | 216 |
|---|---|---|---|---|
| 1 | IR Oxidation | 0 | 28.91 | 54.69 |
| 2 | ($cm^{-1}$) | 0 | 25.00 | 50.78 |
| A | | 0 | 54.41 | — |
| B | | 0 | 47.06 | 70.59 |
| 1 | IR Nitration | 0 | 3.13 | 7.81 |
| 2 | ($cm^{-1}$) | 0 | 3.13 | 6.25 |
| A | | 0 | 20.59 | — |
| B | | 0 | 12.50 | 22.79 |

A dash indicates that the sample was too thick to measure. In all tests (apart from TBN), lower values indicate superior performance. Thus, the results show the superiority of Examples 1 and 2 over each of Examples A and B that lacked salicylate.

What is claimed is:

1. A gas-fuelled engine lubricating oil composition having a TBN in the range of 2 to 20 comprising:

(A) oil of lubricating viscosity, in a major amount; and added thereto, in respective minor amounts;

(B) one or more metal hydrocarbyl-substituted salicylate detergents having a TBN of 95 or less; and (C) one or more single surfactant salicylate detergents or complex metal detergents containing salicylate surfactant, having a TBN of greater than 250;

wherein the lubricating oil composition is substantially free of single surfactant, sulfonate detergents.

2. The composition as claimed in claim 1, wherein the metal of the hydrocarbyl-substituted salicylate (B) is calcium.

3. The composition as claimed in claim 1, wherein metal detergent (C) is a calcium hydrocarbyl-substituted salicylate or a complex detergent that contains a salicylate surfactant, having a TBN in the range of 250 to 500.

4. An additive package or concentrate for a gas-fuelled engine lubricating oil composition, comprising:

(B) one or more metal hydrocarbyl-substituted salicylate detergents having a TBN of 95 or less; and (C) one or more single surfactant salicylate detergents or complex metal detergents containing salicylate surfactant, having a TBN of greater than 250;

wherein the addivive package or concentrate is substantially free of single surfactant, sulfonate detergents.

5. The composition as claimed in claim 1, further comprising, in minor amounts, at least one of:

(D) one or more dispersants; and (E) one or more antiwear additives.

6. The composition as claimed in claim 5, wherein said dispersants are ashless dispersants.

7. The composition as claimed in claim 1, further comprising, in a minor amount;

(F) one or more antioxidants.

8. The composition as claimed in claim 7, wherein said antioxidants are amine or phenolic antioxidants.

9. The composition as claimed in claim 7, wherein said antioxidant is present in said composition in an amount of up to 3 mass %.

10. The composition as claimed in claim 3, wherein the TBN of metal detergent (C) is in the range of 260 to 400.

* * * * *